US010993510B1

(12) United States Patent
Trammell

(10) Patent No.: US 10,993,510 B1
(45) Date of Patent: May 4, 2021

(54) COMBINATION HAIR STRAP AND WRIST BRACELET DEVICE

(71) Applicant: Anna Jane Trammell, Bixby, OK (US)

(72) Inventor: Anna Jane Trammell, Bixby, OK (US)

( * ) Notice: Subject to any disclaimer, the term of this patent is extended or adjusted under 35 U.S.C. 154(b) by 263 days.

(21) Appl. No.: 15/843,241

(22) Filed: Dec. 15, 2017

Related U.S. Application Data

(60) Provisional application No. 62/434,750, filed on Dec. 15, 2016.

(51) Int. Cl.

| | |
|---|---|
| ***A44C 5/20*** | (2006.01) |
| ***A45D 8/34*** | (2006.01) |
| ***A45D 8/36*** | (2006.01) |
| ***A44C 5/00*** | (2006.01) |

(52) U.S. Cl.
CPC ..... *A44C 5/0007* (2013.01); *A44C 5/0053* (2013.01); *A45D 8/34* (2013.01)

(58) Field of Classification Search
CPC ..... A44C 5/0061; A44C 5/10; A44C 5/102; A44C 5/105; A44C 5/107; A44C 5/007; A44C 5/0053; A44C 5/08; A44C 11/00; A45D 8/34
USPC ..... 63/3.1, 3.2, 43, 4, 11; 132/222, 273
See application file for complete search history.

(56) References Cited

U.S. PATENT DOCUMENTS

| | | | | |
|---|---|---|---|---|
| 3,224,054 | A * | 12/1965 | Lige | B65D 63/10 24/16 PB |
| 5,987,706 | A * | 11/1999 | Boe | B65D 63/1018 24/16 PB |
| 7,404,238 | B2 * | 7/2008 | McNeill | B65D 63/1027 24/16 PB |
| 9,802,742 | B1 | 10/2017 | Castro | |
| 9,894,965 | B2 * | 2/2018 | Edmonston | A44C 15/005 |
| 2016/0353846 | A1 * | 12/2016 | Zanghi | A44C 5/0053 |

* cited by examiner

*Primary Examiner* — Jack W Lavinder
(74) *Attorney, Agent, or Firm* — Head, Johnson, Kachigian & Willkinson, PC

(57) ABSTRACT

A combination hair strap and wrist bracelet device. The device includes an elongated flexible strap having a first end and an opposed second end. A double-securing mechanism includes a protruding connector extending from the first end of the strap and a plurality of receiving connectors spaced apart on the strap, wherein the protruding connector connects with one of the receiving connectors and the protruding connector also connects with another of the receiving connectors.

3 Claims, 14 Drawing Sheets

COMBINATION HAIR STRAP AND WRIST BRACELET DEVICE

CROSS REFERENCE

This application claims priority to and the benefit of U.S. Provisional Patent Application Ser. No. 62/434,750, filed Dec. 15, 2016, which is incorporated herein in its entirety by reference.

BACKGROUND OF THE INVENTION

Field of the Invention

The present invention is directed to a combination hair strap and wrist bracelet device which is convertible between a hair strap or hair tie and a wrist bracelet. In particular, the present invention is directed to a combination hair strap and wrist bracelet device having a double-securing mechanism to securely retain hair in place while providing a comfortable fit for the user.

Description of the Related Art

A wide variety of hair ties have been utilized in order to fasten hair or locks of hair. These ties include retaining hair in ponytails, pigtails, and other configurations. The hair ties are known by a wide variety of names including hair binders, scrunchys, and hair bands.

The hair ties are typically constructed of an elastic or stretchable material. In some cases, the hair tie may not adequately retain the hair, so that the tie slips position, and the hair would no longer be held in place. In other cases, the hair tie would be overly tight and be uncomfortable for the user.

There remains a need for a hair strap that would provide a double-securing mechanism to secure hair without pinching or pulling hair to cause discomfort to the user.

There also remains a need to provide a hair strap with a double-securing mechanism that may be quickly and easily installed and quickly and easily detached.

There also remains a need for a hair strap having an alternate function as a wrist bracelet device.

SUMMARY OF THE INVENTION

The present invention is directed to a combination hair strap and wrist bracelet device. The device includes an elongated flexible strap having a first end and an opposed second end. In one configuration, the elongated strap has a pair of opposed sides with at least one of the opposed sides providing a frictional engagement surface.

A double-securing mechanism includes a protruding connector extending from the first end of the elongated flexible strap. The protruding connector may be a bead, a button, or a hook. In one embodiment, the elongated flexible strap forms a plane and the protruding connector extends outward from the first end within the plane.

The double-securing mechanism also includes a plurality of receiving connectors spaced apart on and along the elongated flexible strap. The receiving connectors may be in the form of a series of spaced apart receiving connectors. The receiving connectors may be in the form of slits, slots, or loops.

The protruding connector extending from the first end of the strap is brought or wrapped around a bunch of hair and then connected with one of the receiving connectors. Thereafter, the remaining portion of the strap is wrapped around the hair and the protruding connector is connected with another of the receiving connectors to form a double-securing mechanism.

In another aspect of the invention, an alternate protruding connector may extend from the opposed second end. Accordingly, the device may be installed from either end. In another aspect of the invention, either or both of the sides may include a decorative surface.

When the device is not used as a hair strap, it may be utilized as a wrist bracelet. A first end of the elongated flexible strap may be wrapped around a wrist. The protruding connector is thereafter connected to one of the receiving connectors while surrounding the wrist to form a bracelet. The elongated flexible strap will have a length at least as long as the circumference of a wrist.

DETAILED DESCRIPTION OF THE INVENTION

The embodiments discussed herein are merely illustrative of specific manners in which to make and use the invention and are not to be interpreted as limiting the scope.

While the invention has been described with a certain degree of particularity, it is to be noted that many modifications may be made in the details of the invention's construction and the arrangement of its components without departing from the scope of this disclosure. It is understood that the invention is not limited to the embodiments set forth herein for purposes of exemplification.

Figure 1:
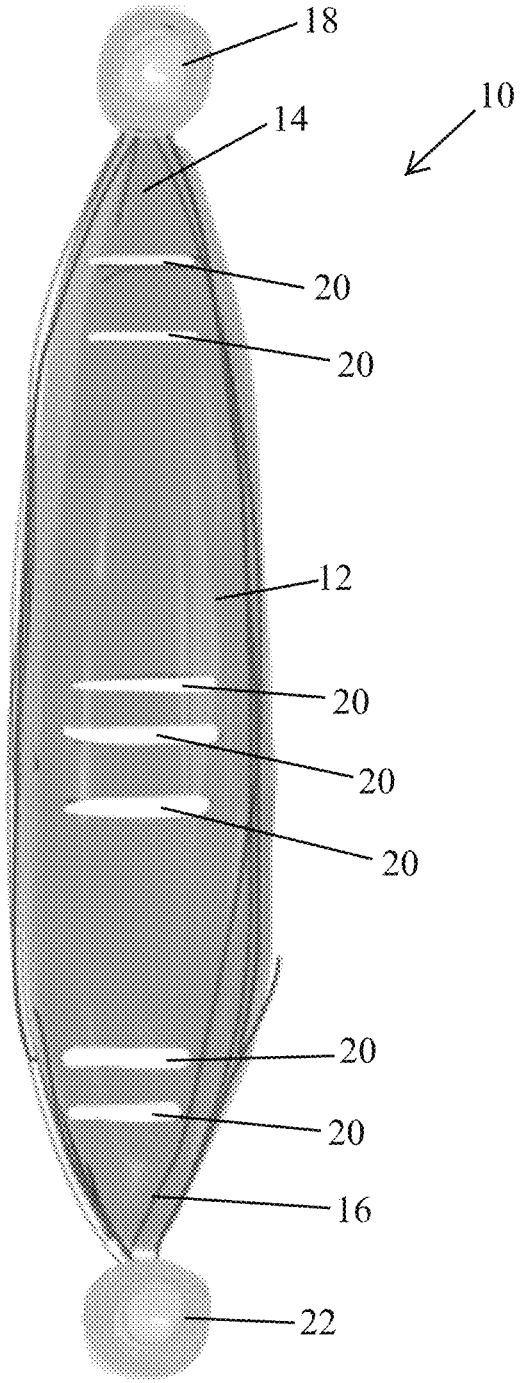
FIG. 1 illustrates a top view of a first preferred embodiment of a combination hair strap and wrist bracelet device constructed in accordance with the present invention.
Figure 2:
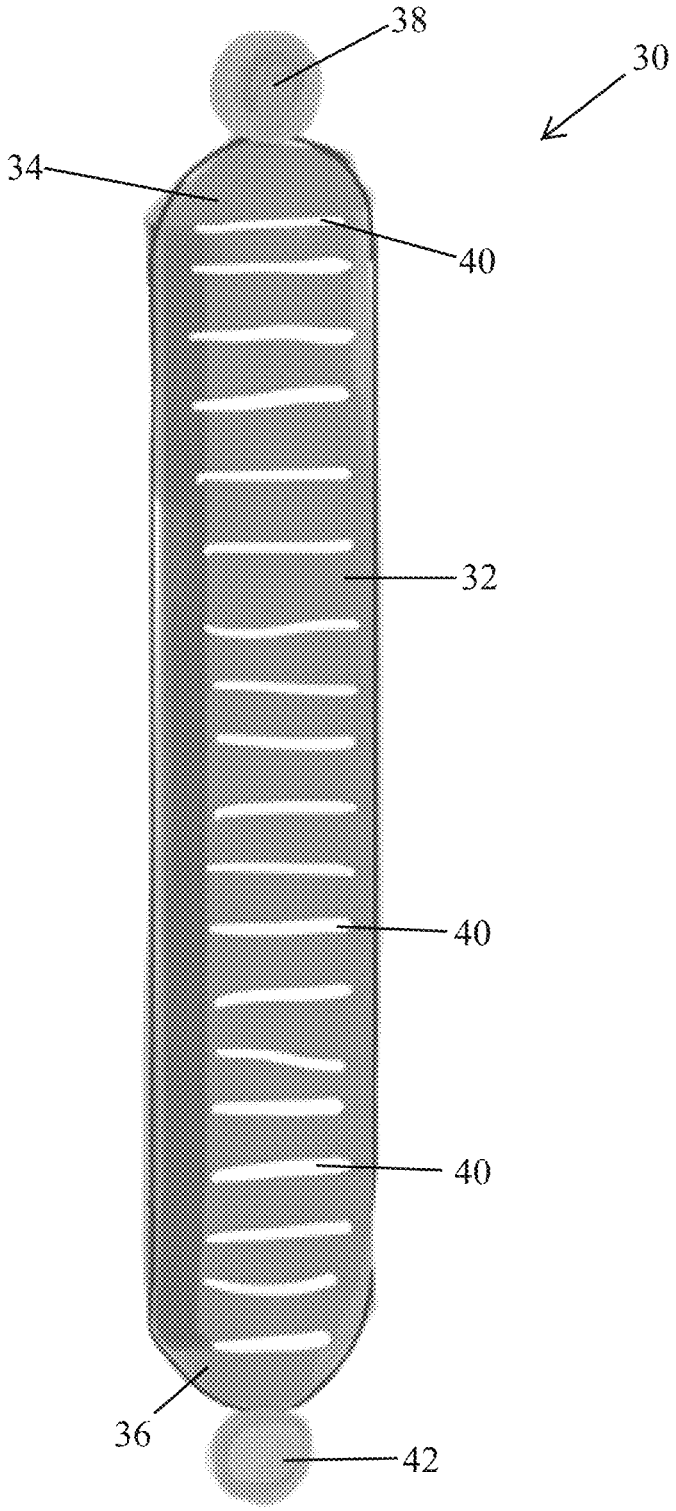
FIG. 2 illustrates a second preferred embodiment of a combination hair strap and wrist bracelet device.

Referring to the drawings in detail, FIG. 1 illustrates a top view of a first preferred embodiment of a combination hair strap and wrist bracelet device 10 constructed in accordance with the present invention. FIG. 2 illustrates a second preferred embodiment of a combination hair strap and wrist bracelet device 30.

The device 10 includes an elongated flexible strap 12 having a first end 14 and an opposed second end 16. The strap is flexible so that it may be wrapped around hair.

As will be explained in detail, the device 10 includes a double-securing mechanism which includes a protruding connector 18 extending outward from the first end 14 of the strap 12. In the embodiment shown, the protruding connector 18 is a bead; however, a button, a hook, or similar item might be employed. The elongated flexible strap 12 forms a plane prior to installation and use. The protruding connector 18 extends outward from the first end 14 of the strap 12 in the same plane.

The double-securing mechanism also includes a plurality of receiving connectors 20 which are spaced apart on and along the elongated flexible strap 12.

In the present embodiment, the receiving connectors 20 form slits similar to a button hole; however, the receiving connectors may alternately be in the form of slots or loops within the spirit and scope of the invention.

The elongated strap 12 has a pair of opposed sides, one of which is visible in FIG. 1. As will be described herein, at least one of the opposed sides of the strap 12 provides a frictional engagement surface. The frictional engagement surface assists in engaging the strap with the hair. Velvet or other similar material may be utilized. In addition, at least one of the opposed sides of the strap 12 includes a decorative surface.

An alternate and optional protruding connector 22 extends from the opposed second end 16 of the strap 12. The second protruding connector 22 may act as a decorative element or may act as a secondary securing mechanism with another receiving connector.

FIG. 2 illustrates a top view of a second preferred embodiment of a combination hair strap and wrist bracelet device 30 constructed in accordance with the present invention. The device 30 includes an elongated flexible strap 32 having a first end 34 and an opposed second end 36. The strap 32 is flexible so that it may be wrapped around hair.

The device 30 includes a double-securing mechanism which includes a protruding connector 38 extending outward from the first end of the flexible strap 32. In the embodiment shown, the protruding connector 38 is a bead; however, a button, a hook, or similar item might be employed as a protruding connector. The elongated flexible strap 32 forms a plane prior to installation and use. The protruding connector 38 extends outward from the first end 34 of the strap in the same plane.

The double-securing mechanism includes a plurality of receiving connectors 40 which are spaced apart on and along the elongated flexible strap 32.

In the present embodiment, the receiving connectors 40 form slits similar to a button hole; however, the receiving connectors alternately may be in the form of slots or loops within the spirit and scope of the present invention.

The elongated strap 32 has a pair of opposed sides, one of which is visible in FIG. 2. As will be described herein, at least one of the opposed sides of the strap 32 provides a frictional engagement surface. The frictional engagement surface assists in engaging the strap with the hair. Velvet or similar material may be used. In addition, at least one of the opposed sides of the flexible strap 32 includes a decorative surface.

An alternate and optional protruding connector 42 extends from the opposed second end of the strap 32.

FIGS. 3 through 7 and FIGS. 8 through 11 illustrate sequential views of the installation procedure or method to install and use the device.

Figure 3:
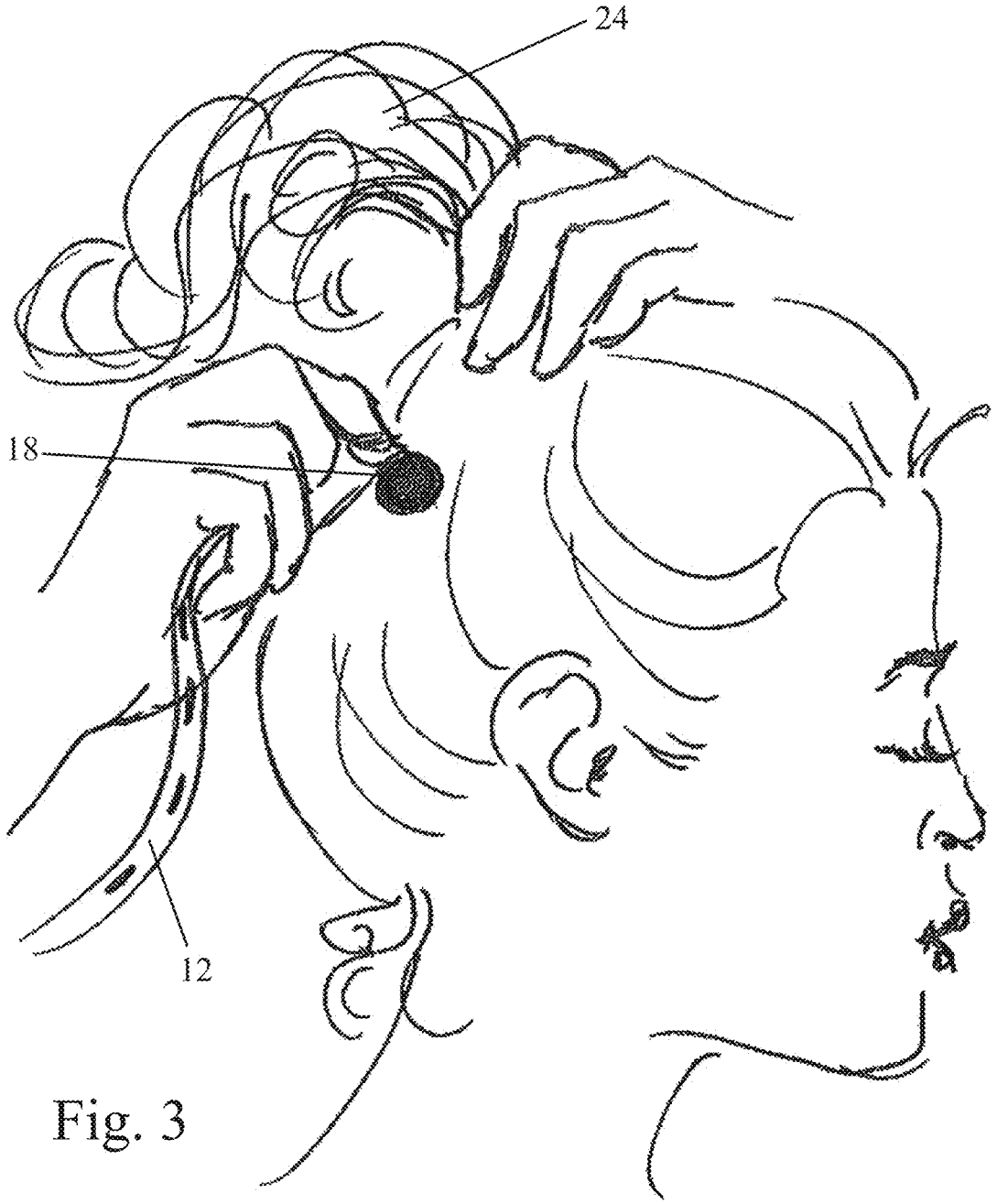
FIGS. 3 through 7 and FIGS. 8 through 11 illustrate sequential views of the installation procedure or method to install and use the device.
Figure 7:
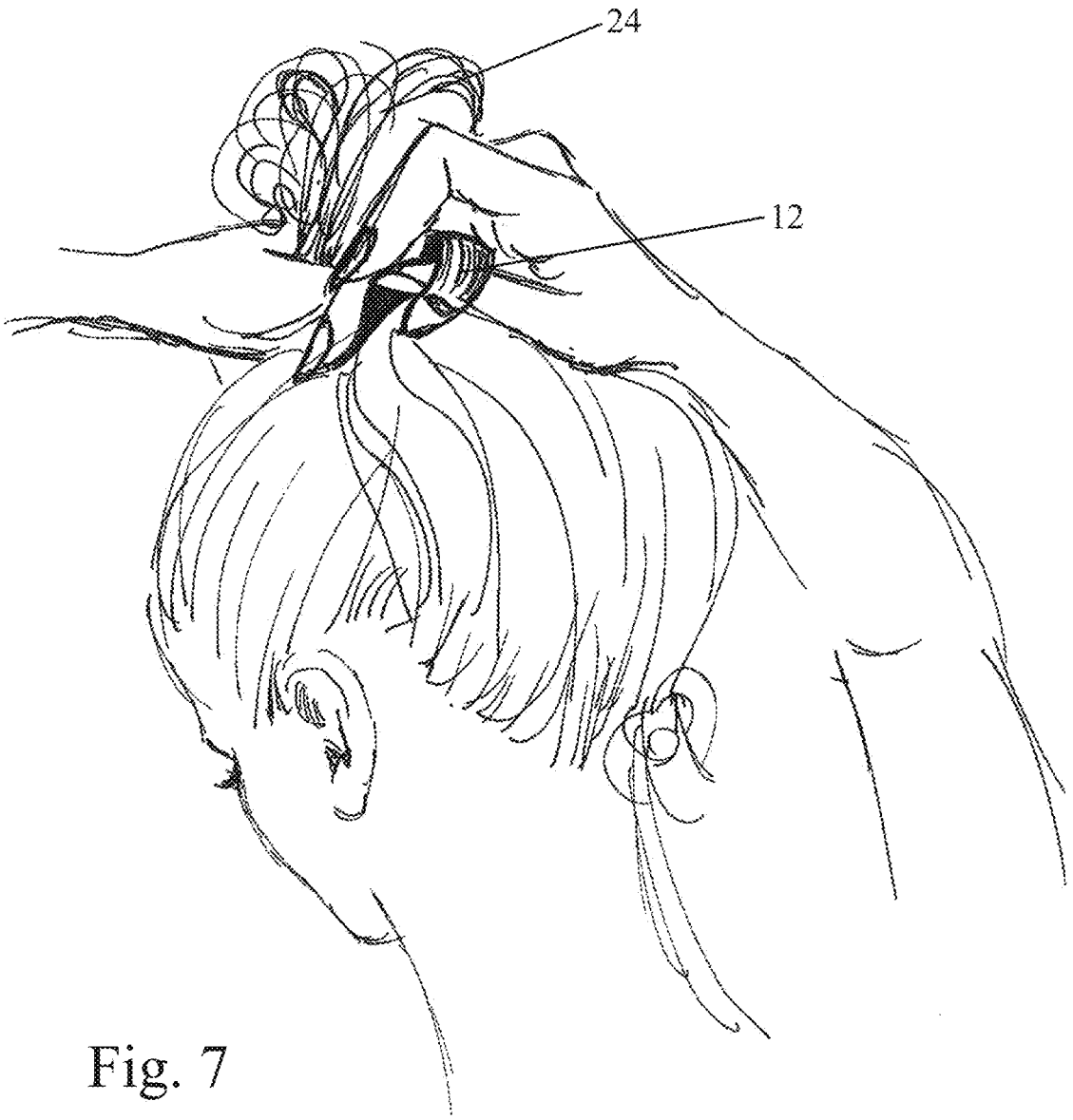

As seen in FIG. 3, while the user is holding locks or a bunch of hair which have been gathered in one hand, a first end 14 of the elongated flexible strap 12 is wrapped around the locks of hair with the other hand. FIG. 7 illustrates this initial step of the procedure from another perspective.

Figure 4:
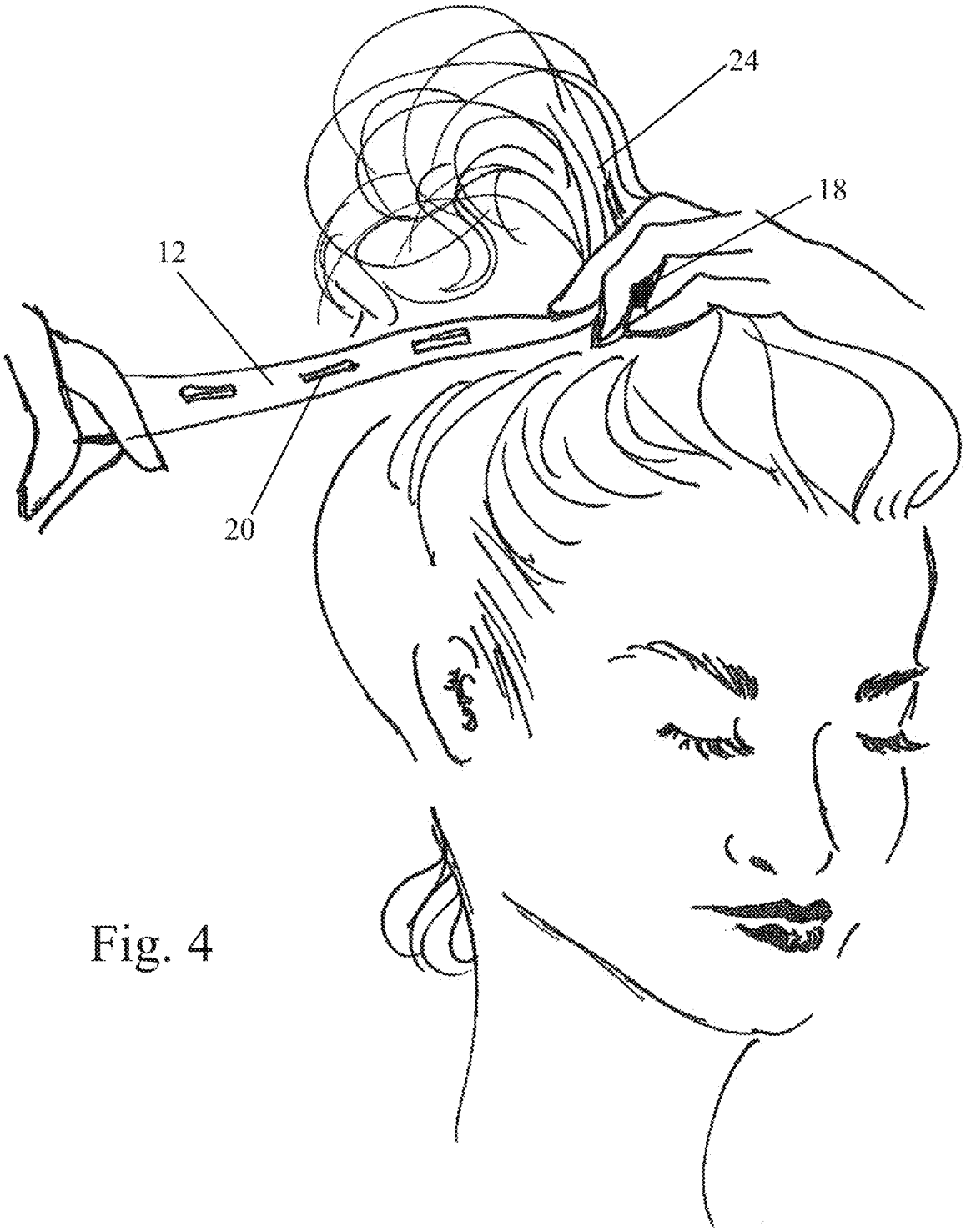

Thereafter, as seen in FIG. 4, the protruding connector 18 is inserted through one of the receiving connectors 20 so that the strap surrounds and circumnavigates the locks of hair 24 and forms a circumference around the hair. One of the receiving connectors 20 is chosen based on the circumference of the gathered locks of hair 24.

Figure 8:
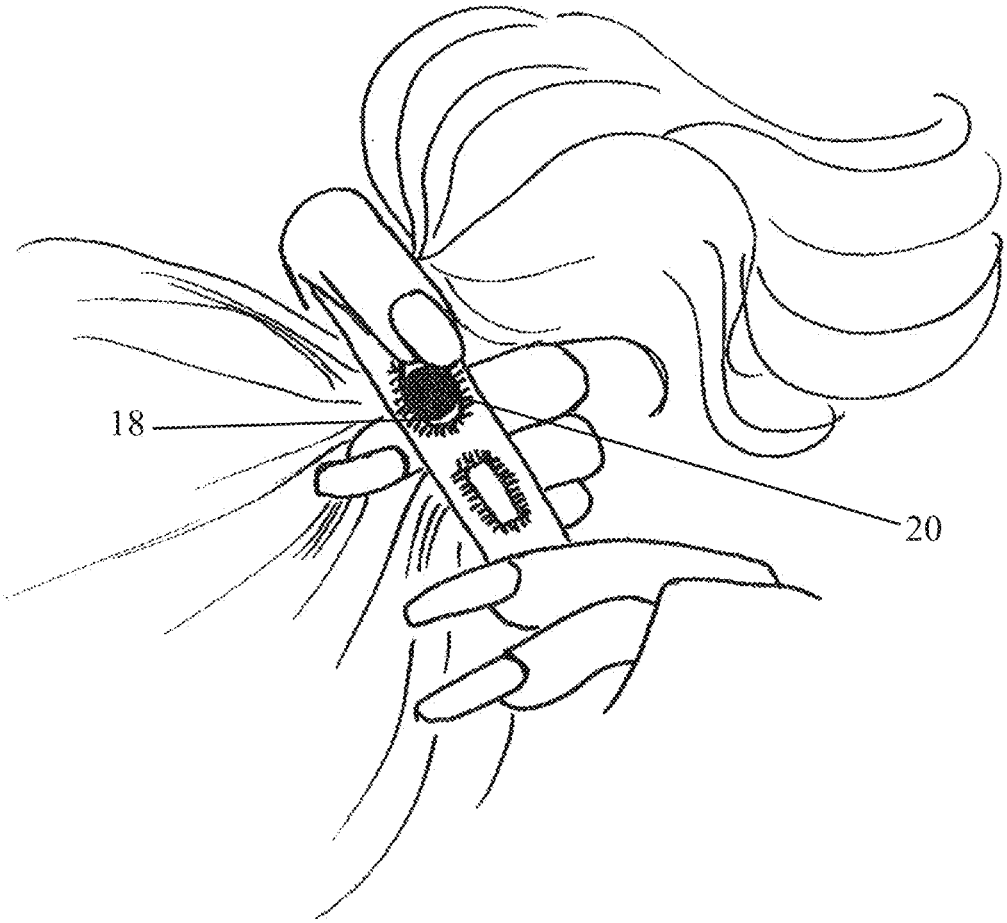

FIG. 8 illustrates a view of this step in the method after securing of the protruding connector 18 to the receiving connector 20 from another perspective.

Figure 5:
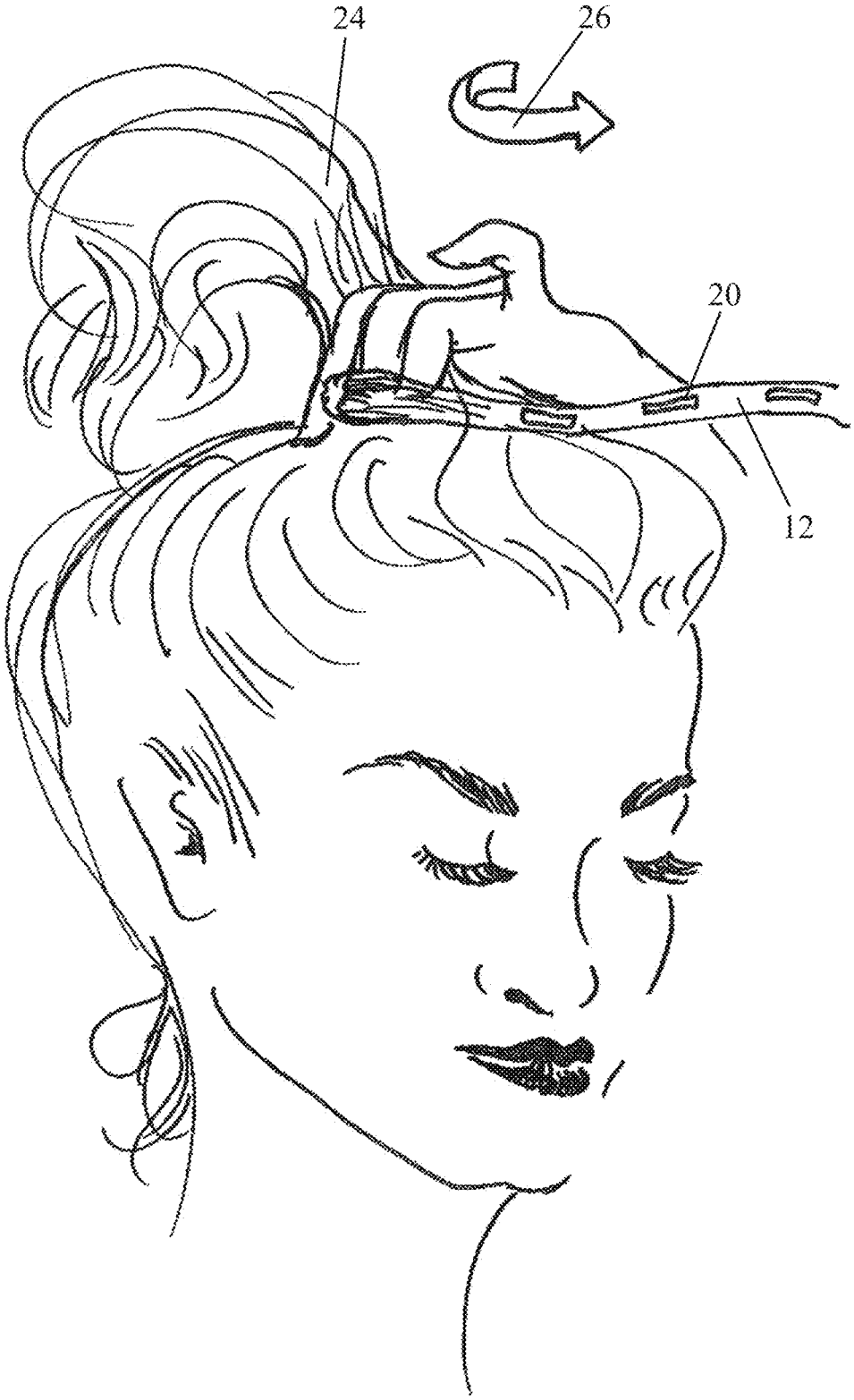
Figure 6:
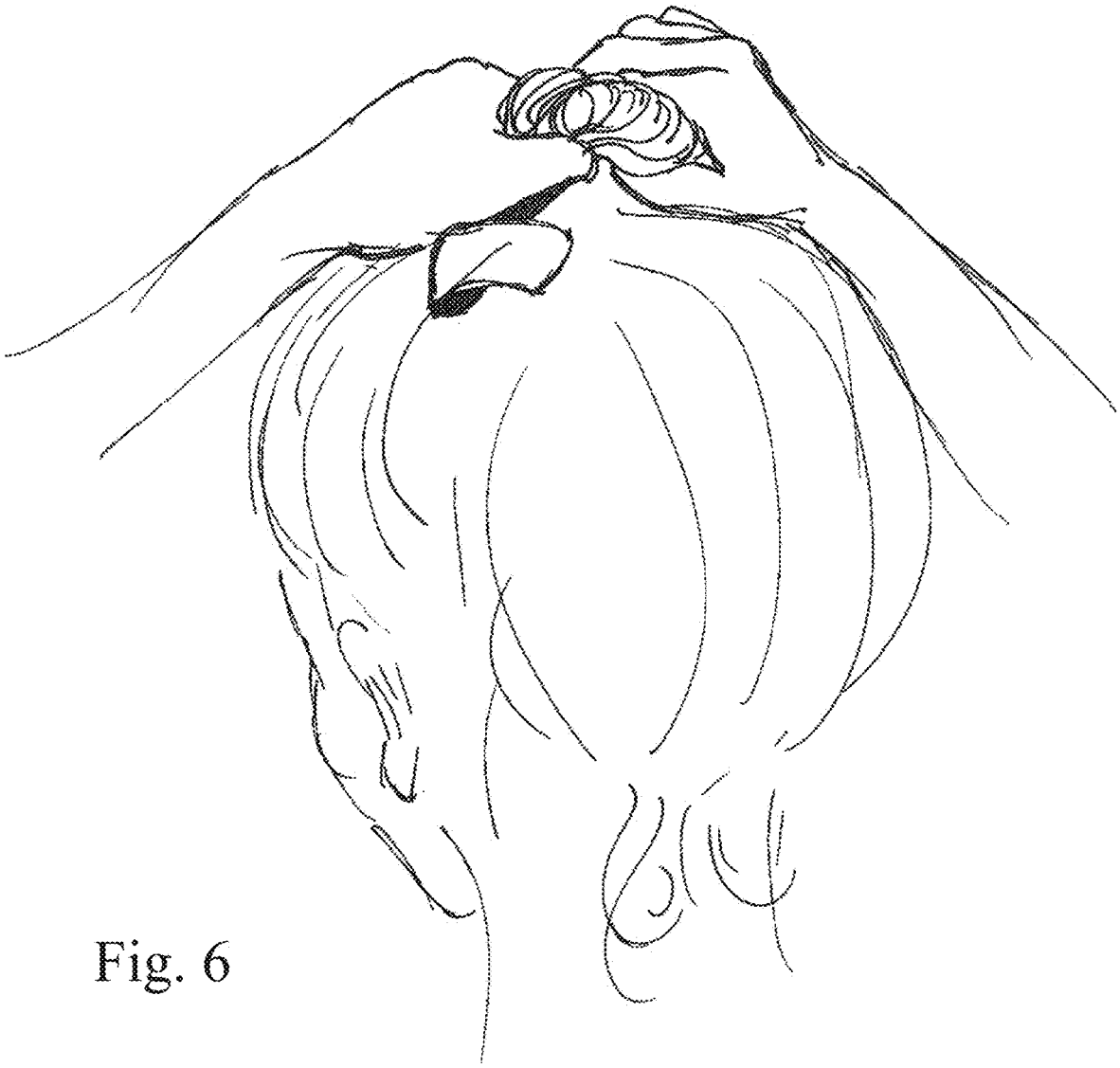
Figure 9:
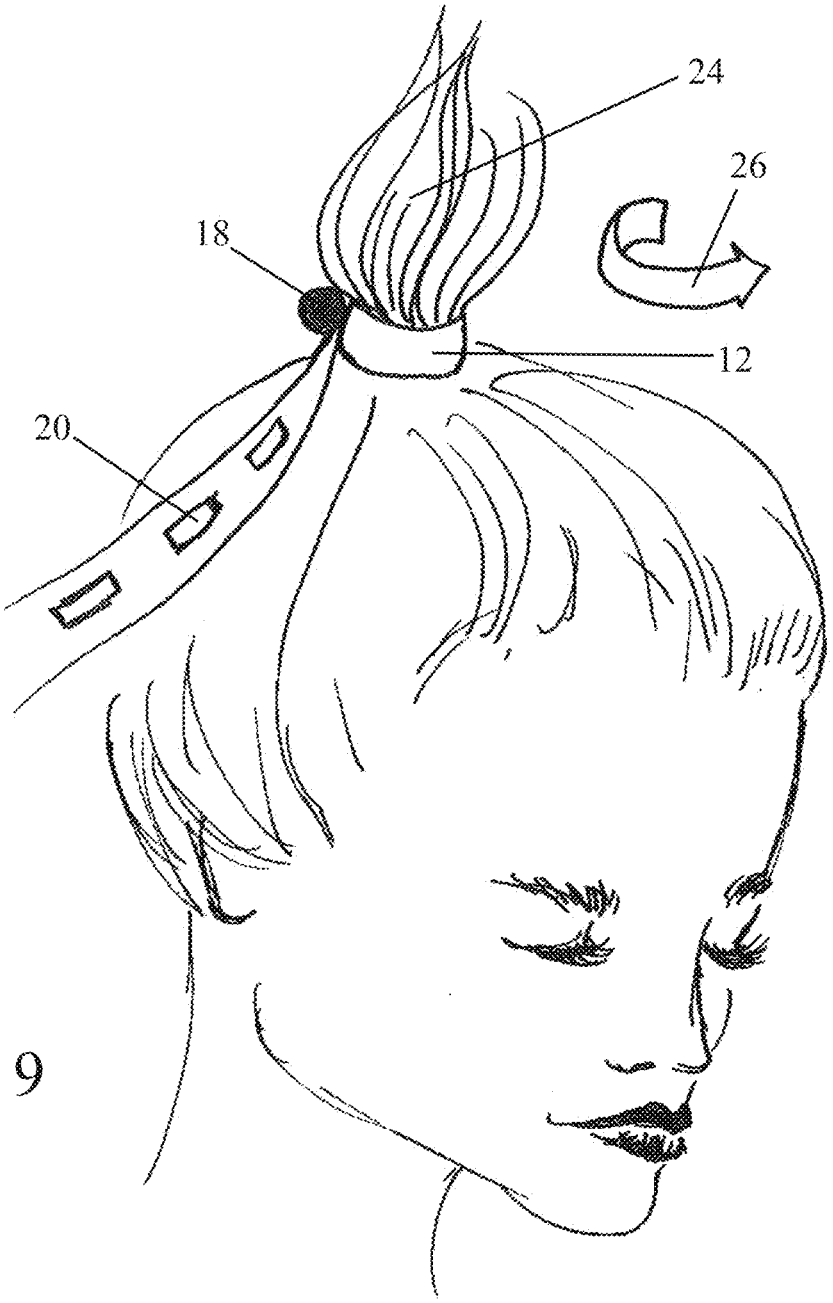
Figure 10:
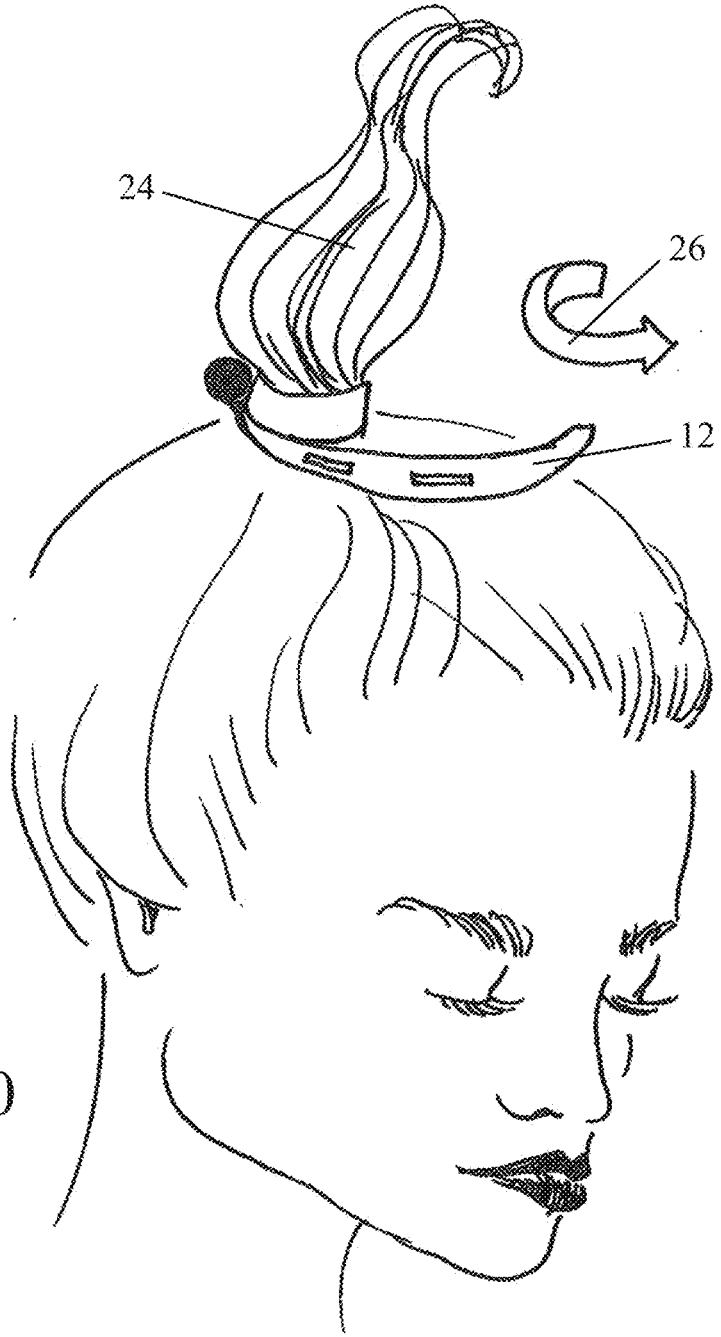

Thereafter, as seen in FIGS. 5 and 9, the remainder of the elongated strap 12 is wrapped at least once, and possibly more than once, in order to surround the first end 14 of the strap and surround the hair in place. Arrow 26 illustrates the movement of the strap 12. FIG. 10 illustrates the strap 12 being wrapped around itself and the hair.

Figure 11:
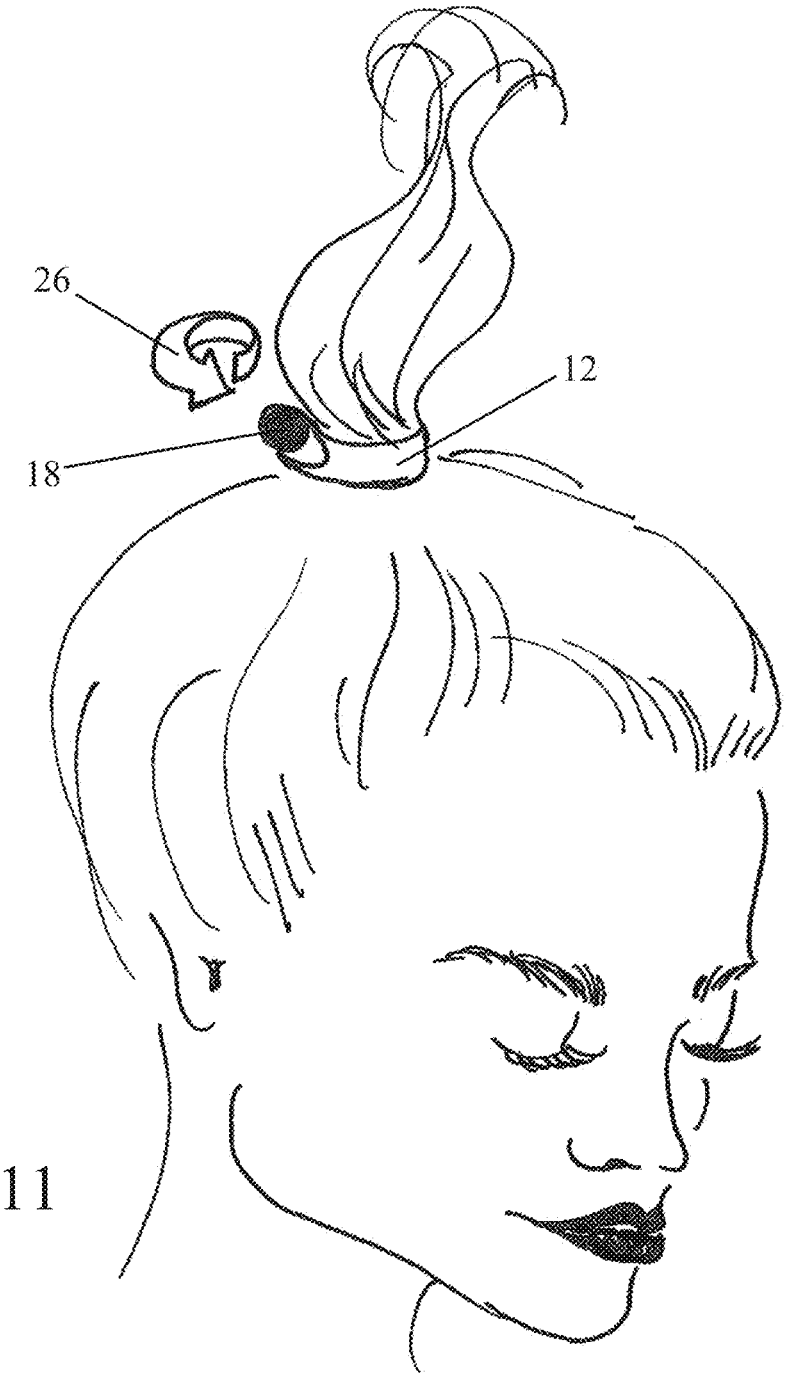

The protruding connector 18 is then inserted and connected to another of the receiving connectors 20 to form a double-securing mechanism. The completion of the operation is shown in FIG. 11. The second receiving connector 20 is chosen based on the circumference of the strap 12.

In the event that an alternate protruding connector 22 is available, the same installation procedure may be utilized starting from the opposed end 16 of the strap 12 with the alternate protruding connector 22 utilized to connect with receiving connectors 20 for the double-securing mechanism.

Figure 12:
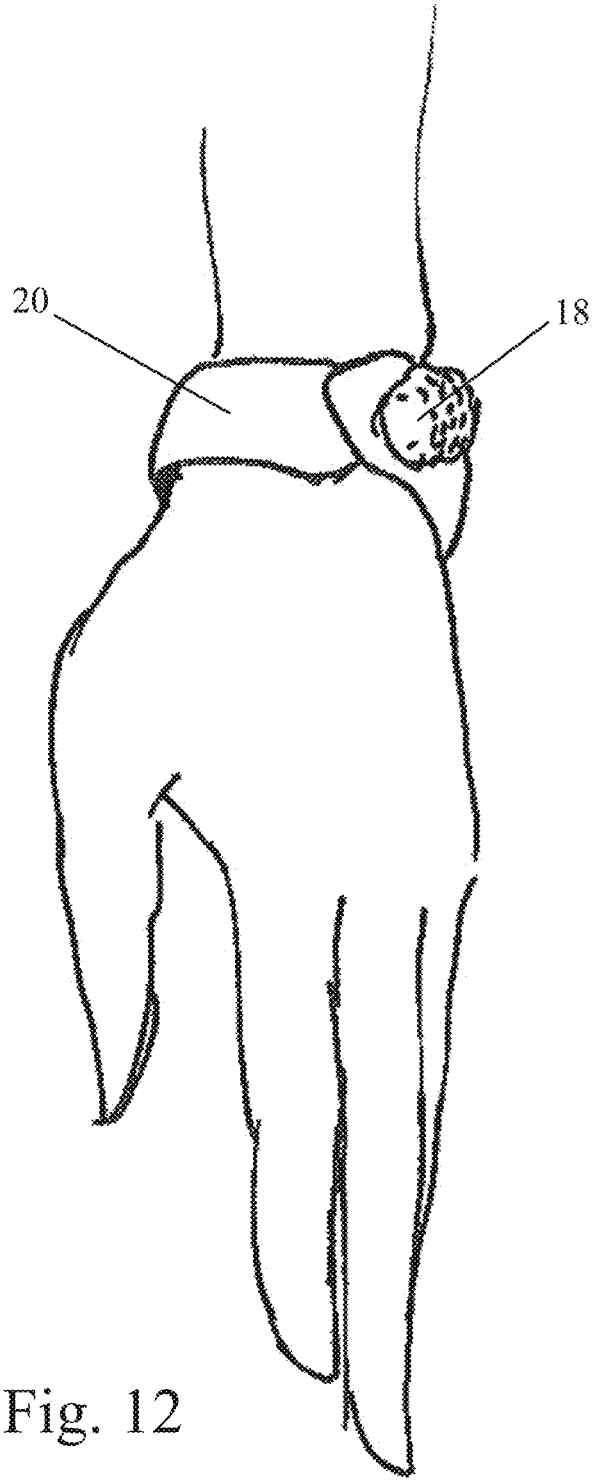
FIG. 12 illustrates an alternate use of the device.

FIG. 12 illustrates an alternate use of the device. The strap 12 is brought around a wrist 44. Thereafter, the protruding connector 18 is inserted and connected to one of the receiving connectors in order to form a wrist bracelet. It will be appreciated that the length of the elongated strap is at least as long as the circumference of the wrist.

Figure 13:
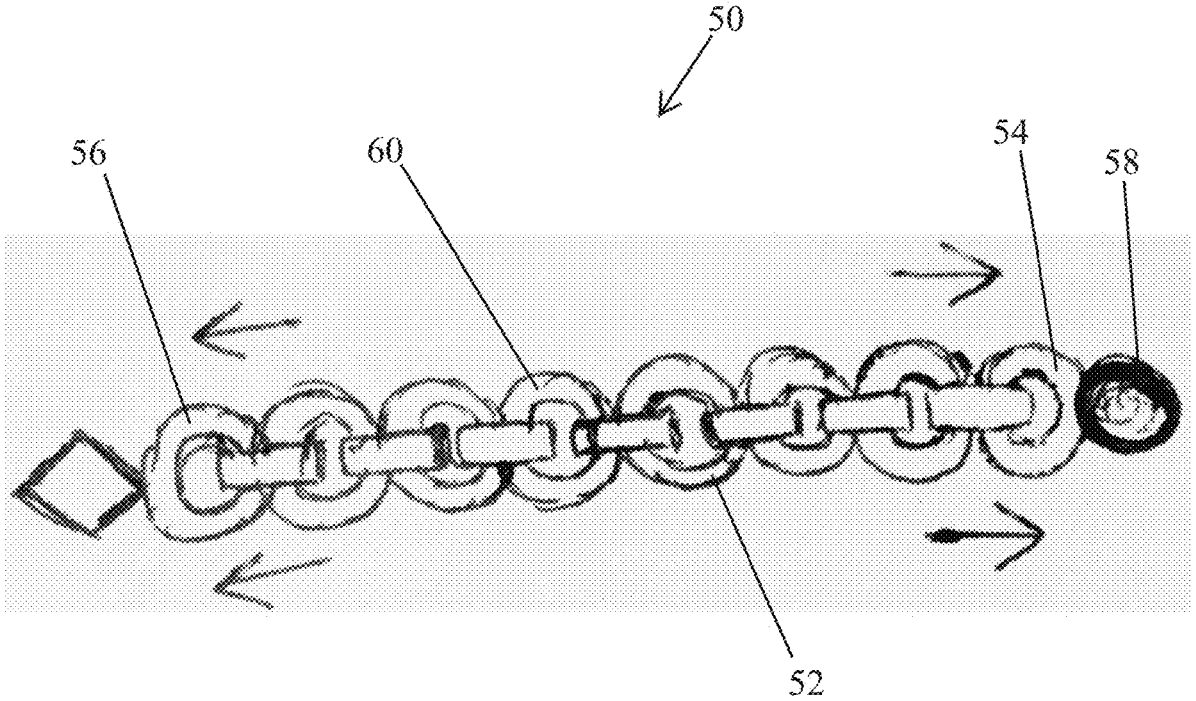
FIGS. 13 and 14 illustrate a further preferred embodiment of the combination hair strap and wrist bracelet device of the present invention.
Figure 14:
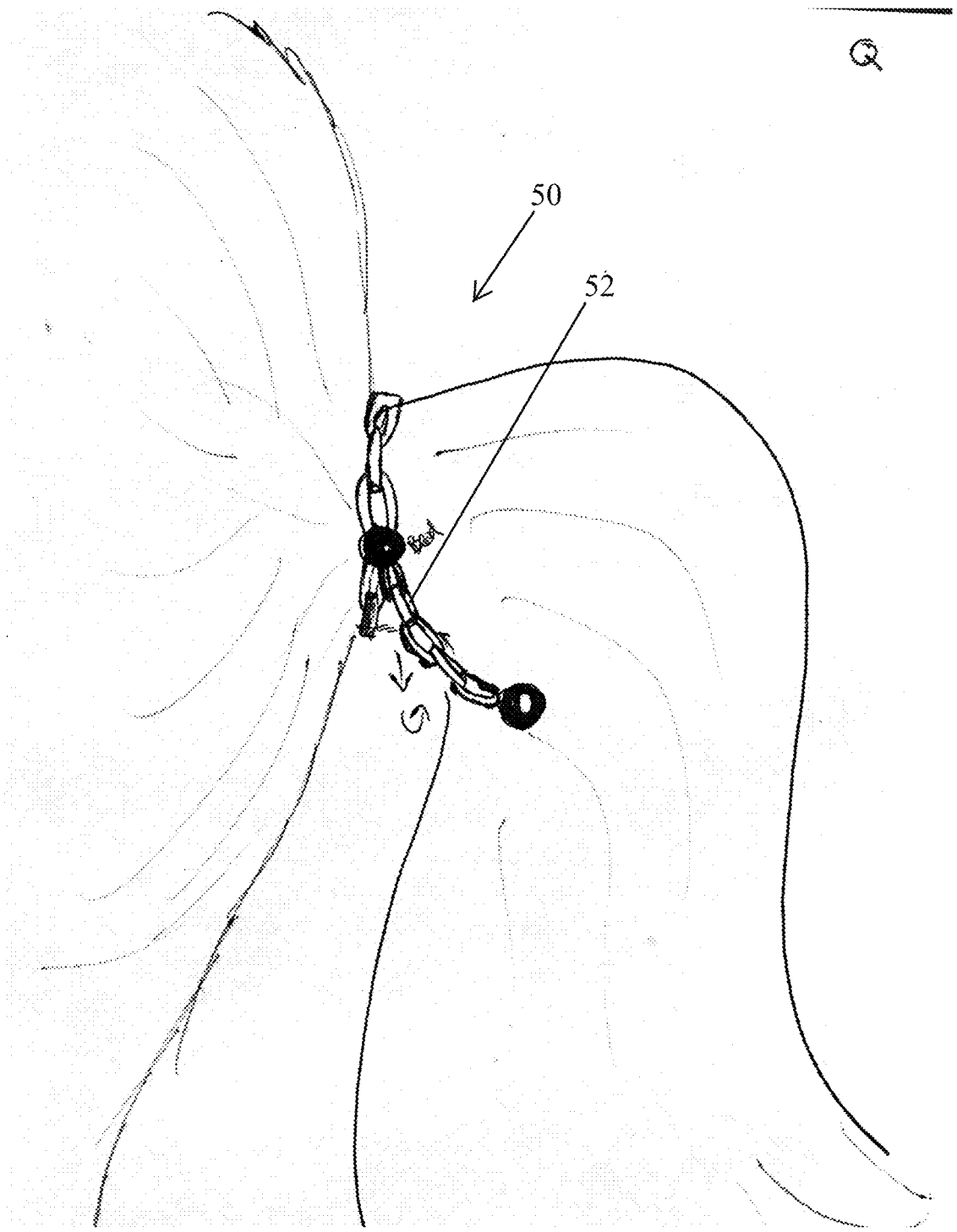

FIGS. 13 and 14 illustrate a further preferred embodiment of the present invention. The device 50 includes an elongated strap 52 having a first end 54 and an opposed second end 56. The device 50 includes a double-securing mechanism which includes a protruding connector 58 extending from the first end 54 of the strap. The protruding connector 58 extends outward from the first end 54 of the strap 52 in the same plane. In the embodiment shown, the protruding connector is a bead; however, a hook or similar item might be employed.

The securing mechanism also includes a plurality of receiving connectors 60. In the embodiment shown, the receiving connectors 60 are in the form of loops or links. The protruding connector 58 is capable of engaging any of the receiving connectors 60.

In yet a further alternate configuration, it is possible to wrap the strap more than twice around the hair, while making a single connection with the protruding connector and a single receiving connector.

Whereas, the invention has been described in relation to the drawings attached hereto, it should be understood that other and further modifications, apart from those shown or suggested herein, may be made within the scope of this invention.

What is claimed is:

1. A combination hair strap and wrist bracelet device, which device comprises:

an elongated flexible strap having a first end and an opposed second end, wherein said flexible strap is comprised of a plurality of links in the form of loops; and;

a securing mechanism having a protruding connector extending from said first end of said elongated flexible strap, wherein said protruding connector is a bead and wherein said plurality of links form a plurality of receiving connectors spaced apart on said elongated flexible strap, wherein said bead connects with one of said receiving connectors and said bead also connects with another of said receiving connectors, and wherein said elongated flexible strap forms a plane and said bead extends from said first end in said plane.

2. The combination hair strap and wrist bracelet device as set forth in claim 1 wherein said elongated flexible strap has a length at least as long as the circumference of a wrist.

3. The combination hair strap and wrist bracelet device as set forth in claim 1 including an alternate protruding connector extending from said opposed second end.

* * * * *